US006897879B2

(12) United States Patent
Lyapunov et al.

(10) Patent No.: US 6,897,879 B2
(45) Date of Patent: May 24, 2005

(54) HARDWARE-ENHANCED GRAPHICS ACCELERATION OF PIXEL SUB-COMPONENT-ORIENTED IMAGES

(75) Inventors: Mikhail M. Lyapunov, Woodinville, WA (US); Mikhail V. Leonov, Kirkland, WA (US); Claude Betrisey, Redmond, WA (US); David Colin Wilson Brown, Redmond, WA (US); Mohammed Gaber El-Gammal, Woodinville, WA (US)

(73) Assignee: Microsoft Corporation, Redmond, WA (US)

( * ) Notice: Subject to any disclaimer, the term of this patent is extended or adjusted under 35 U.S.C. 154(b) by 287 days.

(21) Appl. No.: 10/099,809

(22) Filed: Mar. 14, 2002

(65) Prior Publication Data

US 2003/0174145 A1 Sep. 18, 2003

(51) Int. Cl.[7] ..... G09G 5/00

(52) U.S. Cl. ..... 345/613; 345/614; 345/615; 345/589; 345/592; 345/629; 345/649; 345/660

(58) Field of Search ..... 345/613, 614, 345/615, 589, 592, 629, 649, 660

(56) References Cited

U.S. PATENT DOCUMENTS 5,237,650 A * 8/1993 Priem et al. ..... 345/443
5,651,104 A * 7/1997 Cosman ..... 345/428
6,072,500 A * 6/2000 Foran et al. ..... 345/611
6,173,372 B1 * 1/2001 Rhoades ..... 711/147
6,278,466 B1 * 8/2001 Chen ..... 345/473
6,356,278 B1 3/2002 Stamm et al. ..... 345/611
6,535,220 B2 * 3/2003 Deering et al. ..... 345/582
2002/0167523 A1 * 11/2002 Taylor et al. ..... 345/582

FOREIGN PATENT DOCUMENTS

| | | | |
|---|---|---|---|
| EP | 0 924 650 | 6/1999 | ..... G06T/11/20 |
| EP | 1 077 445 | 2/2001 | ..... G09G/5/28 |
| WO | WO 00/21068 | 4/2000 | ..... G09G/5/02 |
| WO | WO 02/01546 | 1/2002 | ..... G09G/5/02 |

* cited by examiner

*Primary Examiner*—Matthew C. Bella
*Assistant Examiner*—Mike Rahmjoo
(74) *Attorney, Agent, or Firm*—Workman Nydegger

(57) ABSTRACT

Hardware acceleration of the rending and animation of characters that treat each pixel sub-component as a distinct luminance intensity source. A bit-map representation of the sub-component-oriented character is generated by using a single image sample to generate each pixel sub-component. This may be accomplished by, for example overscaling a representation of the character, placing the overscaled representation of the character on grid, and then assigning a luminance and possibly a transparency value to each grid position based on the property of the overscaled character at the grid position. The, the character is rendered by interfacing with a hardware graphic unit that perform the final rendering and animation of the character.

19 Claims, 7 Drawing Sheets

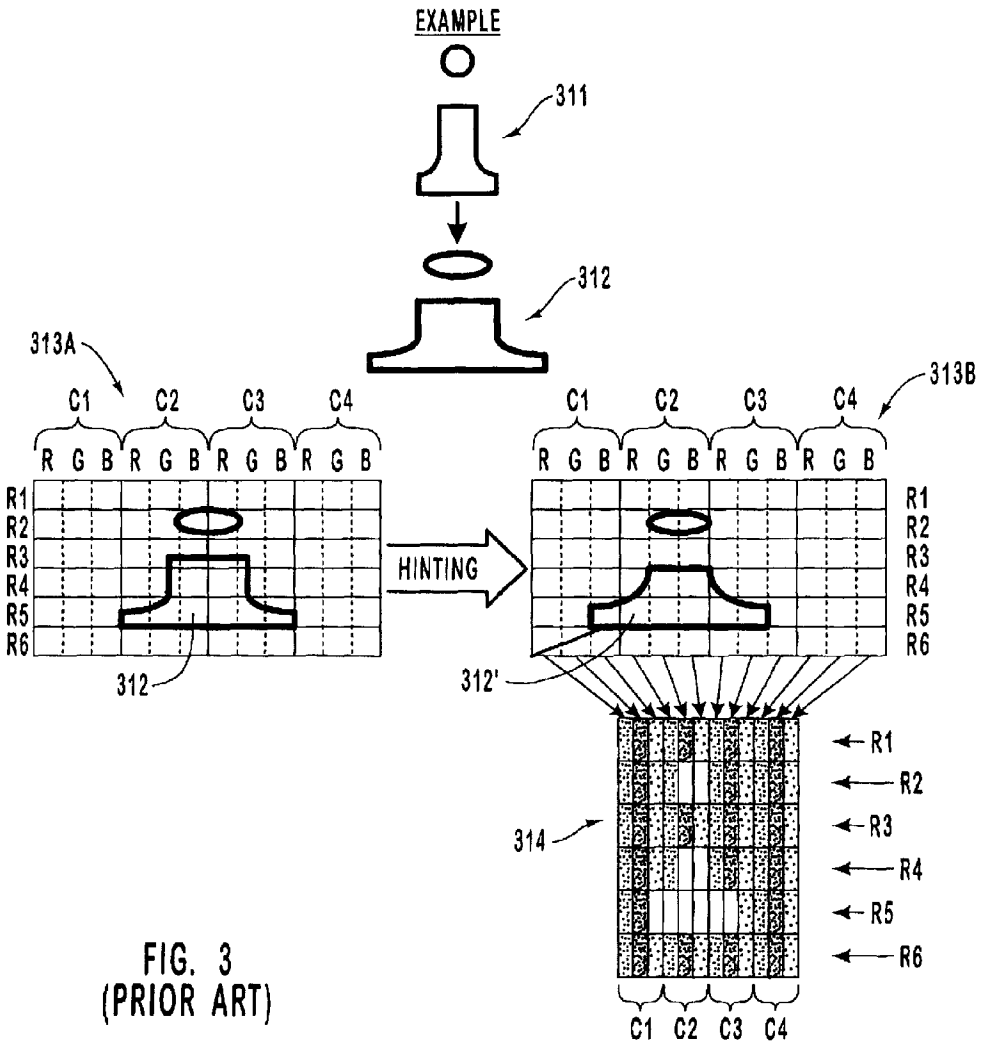
FIG. 3
(PRIOR ART)
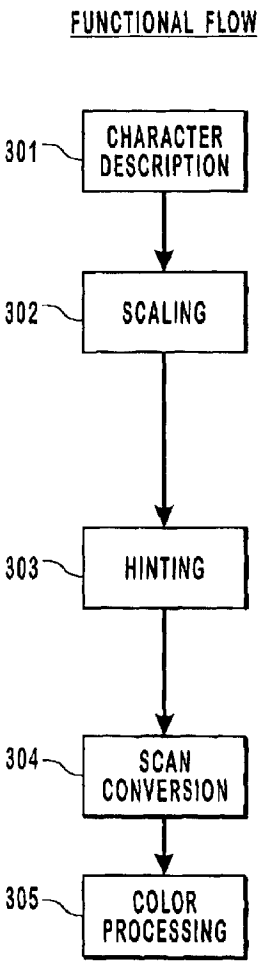

HARDWARE-ENHANCED GRAPHICS ACCELERATION OF PIXEL SUB-COMPONENT-ORIENTED IMAGES

BACKGROUND OF THE INVENTION

1. The Field of the Invention

The present invention relates to methods and systems for displaying images, and more particularly, to methods and systems for efficiently rendering and animating characters using a hardware graphics unit when treating each pixel sub-component as an independent luminance intensity source.

2. Background and Related Art

Display devices are commonly used to render images to a human viewer. The effective rendering of images to a human viewer is fundamental to television and many types of computing technology. Accordingly, display devices are associated with televisions and many computing systems.

Images are rendered to a viewer using thousands of pixels distributed in a grid pattern on a display device. The color and/or intensity values of each of the pixels may be adjusted in order to form the desired image. In a typical display device, the color that a user perceives as emitting from a single pixel is actually represented by multiple displaced color components. For example, in a RGB display device, there is one light source that emits exclusively the color red. Another separate light source exclusively emits the color green. Another separate light source exclusively emit the color blue. These light sources are called herein the red, green, and blue color components of a pixel.

For any given pixel, these color components are spatially offset. However, the spatial offset is sufficiently small that a typical human user is unable to distinguish the individual color components of a pixel. Instead, the light from the color components blends together so that the pixel is perceived to have a single color. This single pixel color may be adjusted by adjusting the intensity of the red, green, and blue color components of the pixel such that the pixel may achieve a wide variety of perceived colors. White may be achieved by having maximum intensities in the red, green, and blue color components. Conversely, black may be achieved by having minimum intensities in the red, green, and blue color components.

Typical television displays and computer monitors rely on each pixel having multiple spatially displaced addressable components, whether those components be red, green, and blue color components, or otherwise. The Liquid Crystal Display (LCD) display is an example of a display device that utilizes multiple distinctly addressable elements, referred to herein as pixel sub-elements or pixel sub-components, to represent each pixel of an image being displayed. For example, FIG. 1 illustrates a conventional portable computer 100, which comprises a housing 101, a disk drive 102, a keyboard 103, and a display 104. The display 104 may be, for example, an LCD display.

Normally, each pixel on a color LCD display is represented by a single pixel element, which usually comprises three non-square pixel subcomponents such as a red pixel sub-component, a green pixel sub-component, and a blue pixel sub-component. Thus, a set of RGB pixel sub-components together makes up a single pixel element. Conventional LCD displays comprise a series of RGB pixel sub-components that are commonly arranged to form stripes along the display. The RGB stripes normally run the entire length of the display in one direction. The resulting RGB stripes are sometimes referred to as "RGB striping". Common LCD monitors used for computer applications, which are wider than they are tall, tend to have RGB stripes running in the vertical direction.

FIG. 2A illustrates a known LCD screen 200 comprising a plurality of rows (R1–R12) and columns (C1–C16) that may be represented on the display 104. Each row/column intersection forms a square (or a rectangle that is almost the same in height as in width), which represents one pixel element. FIG. 2B illustrates the upper left hand portion of the known display 200 in greater detail.

Note in FIG. 2B how each pixel element (e.g., the [R2, C1] pixel element), comprises three distinct sub-components, a red sub-component 206, a green sub-component 207 and a blue sub-component 208. Each known pixel sub-component 206, 207, 208 is approximately one third the width of a pixel while being equal, in height, to the height of a pixel. As illustrated in FIG. 2A and FIG. 2B, one known arrangement of RGB pixel sub-components 206, 207, 208 form what appear to be vertical color stripes down the display 200. Accordingly, the arrangement of ⅓ width color sub-components 206, 207, 208, in the known manner illustrated in FIGS. 2A and 2B, is sometimes called "vertical striping". While only 12 rows and 16 columns are shown in FIG. 2A for purposes of illustration, common column×row ratios include, e.g., 640×480, 800×600, and 1024×768.

In addition to vertical striping, LCDs are manufactured with pixel sub-components arranged in several additional patterns including, e.g., zig-zags and a delta pattern common in camcorder view finders, or in horizontal striping in which the RGB pixel sub-components each have one third of the entire pixel height, and have the same width as the pixel. The features of the present invention can be used with such pixel sub-component arrangements. However, since the RGB vertical striping configuration is more common, the embodiments of the present invention will be explained in the context of using RGB vertically striped displays.

Traditionally, each set of pixel sub-components for a pixel element is treated as a single pixel unit. Accordingly, in known systems luminous intensity values for all the pixel sub-components of a pixel element are generated from the same portion of an image. Consider for example, the image represented by the grid 220 illustrated in FIG. 2C. In FIG. 2C, each square represents an area of an image which is to be represented by a single pixel element including a red, green and blue pixel sub-component of the corresponding square of the grid 220.

In FIG. 2C, a shaded circle is used to represent a single image sample from which luminous intensity values are generated. Note how a single sample 222 of the image 220 is used in known systems to generate the luminous intensity values for each of the red, green, and blue pixel sub-components 232, 233, 234. Thus, in known systems, the RGB pixel sub-components are generally used as a group to generate a single colored pixel corresponding to a single sample of the image to be represented.

The light from each pixel sub-component group effectively adds together to create the effect of a single color whose hue, saturation, and intensity depends on the value of each of the three pixel sub-components. Say, for example, each pixel sub-component has a potential intensity of between 0 and 255. If all three pixel sub-components are given 255 intensity, the eye perceives the pixel as being white. However, if all three pixel sub-components are given a value of 0, the eye perceives a black pixel. By varying the respective intensities of each pixel sub-component, it is possible to generate millions of colors in between these two extremes.

Since, a single sample is mapped to a triple of pixel sub-components which are each ⅓ of a pixel in width, spatial displacement of the left and right pixel sub-components occurs since the centers of these elements is ⅓ from the center of the sample. Consider, for example, that an image to be represented was a red cube with green and blue components equal to zero. As a result of the displacement between the sample and green image sub-component, when displayed on an LCD display of the type illustrated in FIG. 2A, the apparent position of the cube on the display will be shifted one third of a pixel to the left of its actual position. Similarly, a blue cube would appear to be displaced one third of a pixel to the right. Thus, conventional imaging techniques used with LCD screens can result in undesirable image displacement errors.

Text characters represent one type of image which is particularly difficult to accurately display given typical flat panel display resolutions of 72 or 96 dots (pixels) per inch (dpi). Such display resolutions are far lower than the 600 dpi supported by most printers and the even higher resolutions found in most commercially printed text such as books and magazines. Accordingly, smaller visual objects such as text characters may appear coarse when the image resolution is limited to the pixel resolution.

Indeed, conventional wisdom was that the image resolution was necessarily limited to the pixel resolution. However, a technique for improving the resolution to the resolution of the pixel sub-component is described in a U.S. patent application Ser. No. U.S. Pat. No. 6,188,385 B1, issued Feb. 13, 2001, to William Hill et al., and entitled "Method and Apparatus for Displaying Images Such As Text" (hereinafter referred to as the "Hill et al. patent"), which is incorporated herein by reference in its entirety. A display technology that incorporates at least some of the technology described in the Hill et al. patent is often referred to as CLEARTYPE®, which term is a registered trademark of Microsoft Corporation.

The Hill et al. patent describes a technology that treats each pixel sub-component as a separate independent luminous intensity source. This contrasts with the conventional technique of treating the set of RGB pixel sub-components for a given pixel as being a single luminous intensity source.

In other words, the Hill et al. patent describes that each image sample is used to generate the luminance intensity value for a single pixel sub-component. This contrasts with the conventional technique of generating all of the pixel sub-component values for a given pixel using a single image sample. Thus, the technology described in the Hill et al. patent allows for a display device with RGB vertical striping to have an effective horizontal resolution that is up to three times greater than the horizontal pixel resolution.

FIG. 3 illustrates a general functional flow that may be implemented by the computer 100 in order to render and rasterize text images on the display 104 using the technology described in the Hill et al. patent. Suppose for purposes of discussion, that an application running on the computer 100 instructs the computer's operating system that the letter i having a given font and point size, is to be rendered and rasterized on the display 104. The left column of FIG. 3 labeled under the heading "Functional Flow" illustrates the general functions that are implemented to render a text character using this technology. The right column of FIG. 3 under the heading "Example" represents the state of the character i after the corresponding function to the left is implemented.

The process begins with a character description 301, which describes the form of a character. This may be accomplished by using vector graphics, lines, points and curves, from which a high-resolution digital representation of the character may be derived. A typical operating system will have a number of different character descriptions corresponding to each character of each font. Element 311 shows the visual representation of the character description for the letter i. In addition to the text information, the operating system also has access to background color and layout information for the images that are currently being displayed, and brush color and transparency information that are to be applied to the text character during rendering.

With this character and display information, operation proceeds to scaling 302 where non-square scaling is performed as a function of the direction and/or number of pixel sub-components included in each pixel element. In particular, the vertical direction of the character described in the character description is scaled so as to meet the height requirements for the point size specified by the application. However, the horizontal direction is scaled at a rate three times greater than in the vertical direction. This allows for subsequent image processing operations to take advantage of the higher horizontal degree of resolution that can be achieved by using individual pixel sub-components as independent luminous intensity sources in a vertically striped display.

In the simplest case, the scaling in the horizontal direction is at a relative rate that is related to the number of pixel sub-components in a given pixel. In the RGB vertical striping display, there are three pixel sub-components in any given pixel. Accordingly, in the simplest case, scaling in the horizontal direction occurs at a rate approximately three times the rate of scaling in the vertical direction. This scaling may occur by manipulating the character description as appropriate. Element 312 shows the state of the character represented by the scaled character description. Note that in the illustrated case where the height of the character remains the same, the letter i is stretched horizontally by a factor of approximately three during scaling.

After scaling 302, operation proceeds to hinting 303. The term "grid-fitting" is sometimes used to describe the hinting process. Hinting involves the alignment of a scaled character within a grid. It also involves the distorting of image outlines so that the image better conforms to the shape of the grid. The grid is determined as a function of the physical size of a display device's pixel elements. Unlike earlier techniques that failed to take into consideration pixel sub-component boundaries during hinting, hinting 303 treats pixel sub-component boundaries as boundaries along which characters can and should be aligned or boundaries to which the outline of a character should be adjusted.

The hinting process involves aligning the scaled representation of a character within the grid along or within pixel and pixel sub-component boundaries in a manner intended to optimize the accurate display of the character using the available pixel sub-components. In many cases, this involves aligning the left edge of a character stem with a left pixel or sub-pixel component boundary and aligning the bottom of the character's base along a pixel or pixel sub-component boundary.

Experimental results have shown that in the case of vertical striping, characters with stems aligned so that the character stem has a blue or green left edge generally tend to be more legible than characters with stems aligned to have a red left edge. Accordingly, during hinting of characters to be displayed on a screen with vertical striping, blue or green left edges for stems are favored over red left edges.

During hinting 303, the scaled image 312 is first placed over a grid pattern as represented by grid layout 313A. The grid pattern is shown for four columns of pixels labeled C1 through C4 from left to right, and six rows of pixels labeled R1 through R6 from top to bottom. Note that boundaries between pixel sub-components are represented by dashed lines except where there is also a boundary between pixels. The pixel boundaries are represented as solid lines. Note that each pixel sub-components has a heading R, G, or B representing whether the column represents the red, green, or blue color, respectively.

During hinting 303, the left edge of the scaled i character is aligned along the R/G pixel sub-component boundary so that the left edge of the stern of the hinted character 312' has a green left edge to promote legibility. The shape of the character is also adjusted as well as the position of the character on the grid. Character spacing adjustments are also made.

Once the hinting 303 is complete, operation proceeds to scan conversion 304, which involves the conversion of the scaled geometry representing a character into a bitmap image. Conventional scan conversion operations treat pixels as individual units into which a corresponding portion of the scaled image can be mapped. However, in accordance with the Hill et al. patent, each pixel sub-component is treated as a separate luminous intensity component into which a separate portion of the scaled image can be mapped.

Referring to FIG. 3, the scan conversion operation results in the bitmap image 314. Note how each pixel sub-component of bitmap image columns C1–C4 is determined from a different segment of the corresponding columns of the scaled hinted image 313B. This contrasts with the conventional technique of having all three pixel sub-component values for a given pixel generated from a single portion of an image. Note also how the bitmap image 314, comprises a ⅔ pixel width stem with a left edge aligned along a red/green pixel boundary. Notice also that a dot that is ⅔ of a pixel in width is used. Conventional text imaging techniques that treated each pixel as a single luminous intensity component would have resulted in a less accurate image having a stem a full pixel wide and a dot a full pixel in size.

Once the bitmap representation of the text (i.e., bitmap image 314) is generated during scan conversion 304, it may be output to a display adapter or processed further to perform color processing operations and/or color adjustments to enhance image quality. While the human eye is much more sensitive to luminance edges as opposed to image color (chrominance) edges, treating the RGB pixel sub-components as independent luminous intensity elements for purposes of image rendering can result in undesired color fringing effects. If, for instance, you remove red from an RGB set, a color fringing effect of cyan, the additive of green and blue, is likely to result.

Thus, the bitmap image 314 may be supplied to color processing 305, where image processing is performed to determine how far away from the desired brush color the bitmap image has strayed. If portions of the bitmap image have strayed more than a pre-selected amount from the desired brush color, adjustments in the intensity values of pixel sub-components are applied until the image portions are brought within an acceptable range of an average between the brush and background colors.

The bitmap image 314 is then applied via a blending operation to the existing background image. In particular, for a given pixel, let the red, green, and blue color intensities be given by glyph.r, glyph.g, and glyph.b. A glyph is a term that represent the shape of the character with respect to that pixel sub-components of the given pixel. The three value vector of red, green, and blue color components is represented by the vector glyph.rgb.

The brush or foreground color components are represented by a similar vector brush.rgb. A scalar value of the transparency of the brush at each color component is given by the vector brusha.rgb. The background color for that pixel is given by a three value vector dst.rgb. In order to blend the brushed character onto the background, the following vector equation (1) is applied:

$$DST.rgb=DST.rgb+(\text{brush}.rgb-dst.rgb)*\text{glyph}.rgb*\text{brush}a.rgb \quad (1)$$

In conventional techniques that treat each pixel sub-component as a separate and distinct luminance intensity value, this blending operation, as well as animations of the character (e.g., rotation and scaling) are performed in software. The calculations for performing the blending and animation of a character are quite complex. Even modem computing systems may be challenged by rendering and animating characters that treat each pixel sub-component as an independent luminance intensity source.

Accordingly, what is desired are systems and methods for rendering and animating characters that treat each pixel sub-component as an independent luminance intensity source in a more efficient manner.

SUMMARY OF THE INVENTION

Methods, systems, and computer program products are described for accelerating the rendering and animation of characters in which each pixel sub-component is treated as a distinct luminance intensity source generated from its own distinct sample point. This contrasts with conventional characters in which all pixel sub-components of a particular pixel are generated from a common sample point.

A bit-map representation of the sub-component-oriented character is generated by using a single image sample to generate each pixel sub-component. In particular, in order to render a given character, a graphics unit accesses a character representation that describes the outline of the character. Then, the character representation is overscaled and conceptually placed on a grid. Each grid position corresponds to a sampling point as well as to a particular pixel sub-component. Hinting may occur by adjusting the shape of the character by considering the sub-component boundaries, not just the pixel boundaries. Scan conversion is performed to generate a bit map representation of the character based on the position of the character on the grid. Then, color compensation occurs to compensate for color fringing effects.

After generating the bit map representation, the character is rendered by interfacing with a hardware graphics unit that performs the final rendering and animation of the character. The rendering and animation speed is increased substantially over the prior method of performing rendering and animating in software. In particular, the bit map representation of the character, as well as the bit map representations or the brush and/or the background are adjusted and then a non-conventional sequence of function calls are issued to the hardware graphics unit to cause the hardware graphics unit to render the character by blending the character, scaling the character, and/or rotating the character on a background. Accordingly, the principles of the present invention provide for more efficient rendering and animation of characters that have pixel sub-component values that were generated from individual sample points.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 3 illustrates a general functional flow used to render and rasterize images in which each pixel sub-component is generated from its own distinct sample point.

DETAILED DESCRIPTION OF THE INVENTION

Figure 1:
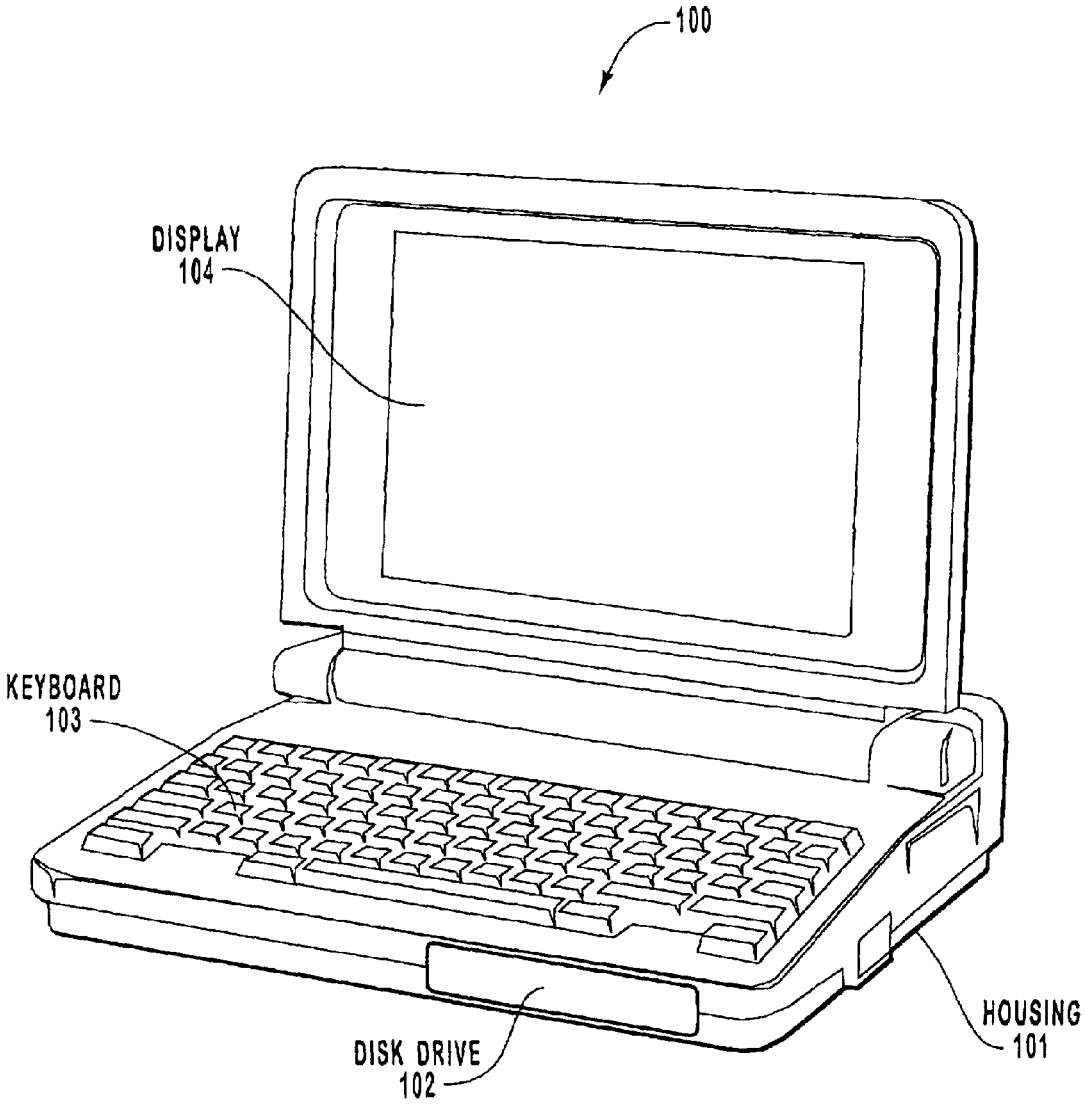
FIG. 1 (PRIOR ART)
FIG. 1 illustrates a convention portable computer in accordance with the prior art.
Figure 2A:
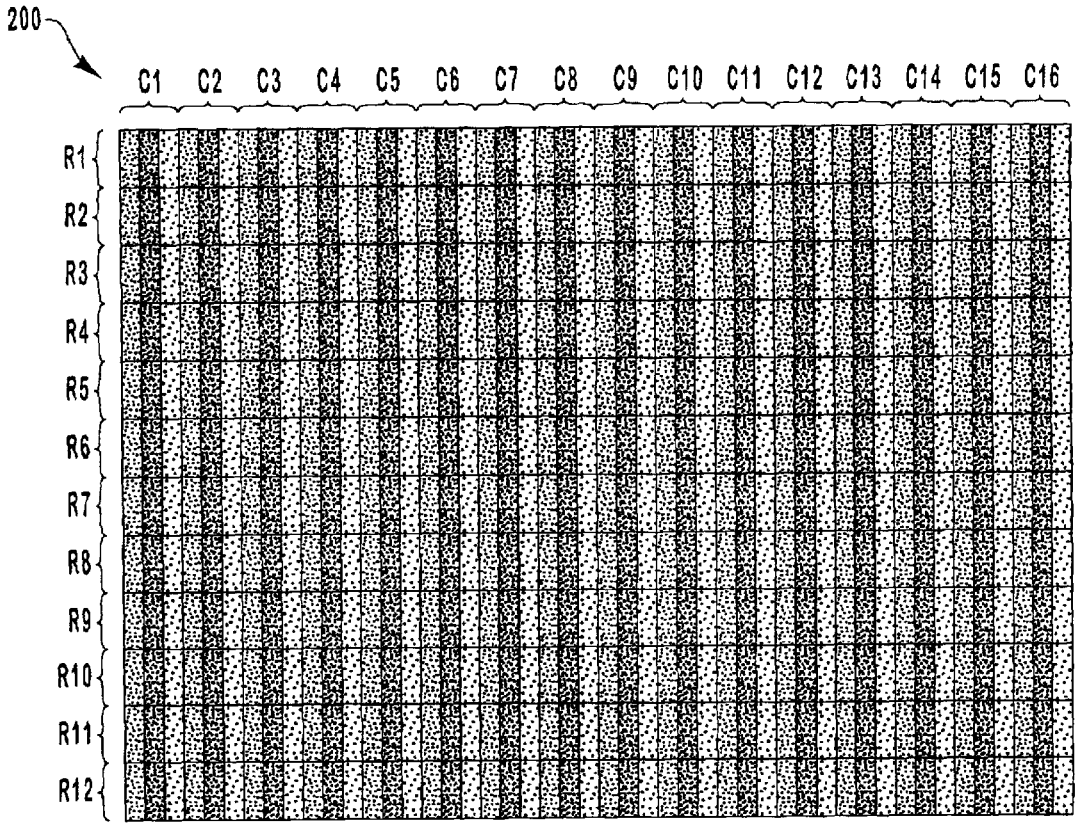
FIG. 2A (PRIOR ART)
FIG. 2A illustrates a vertically-striped display comprising 12 rows and 16 columns of pixels, each pixel having a red, green, and blue pixel sub-component horizontally placed next to each other to form vertical striping in accordance with the prior art.
Figure 2B:
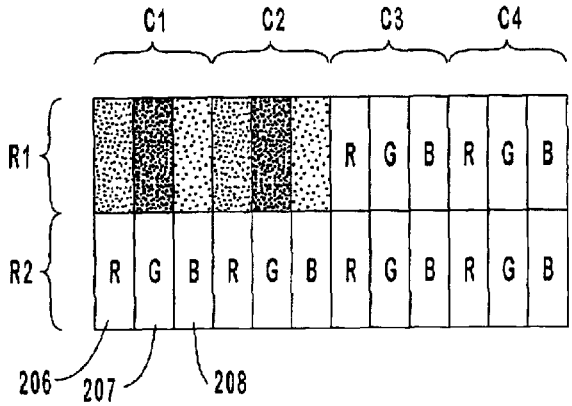
FIG. 2B (PRIOR ART)
FIG. 2B illustrates the upper left-hand portion of the display of FIG. 2A in further detail.
Figure 2C:
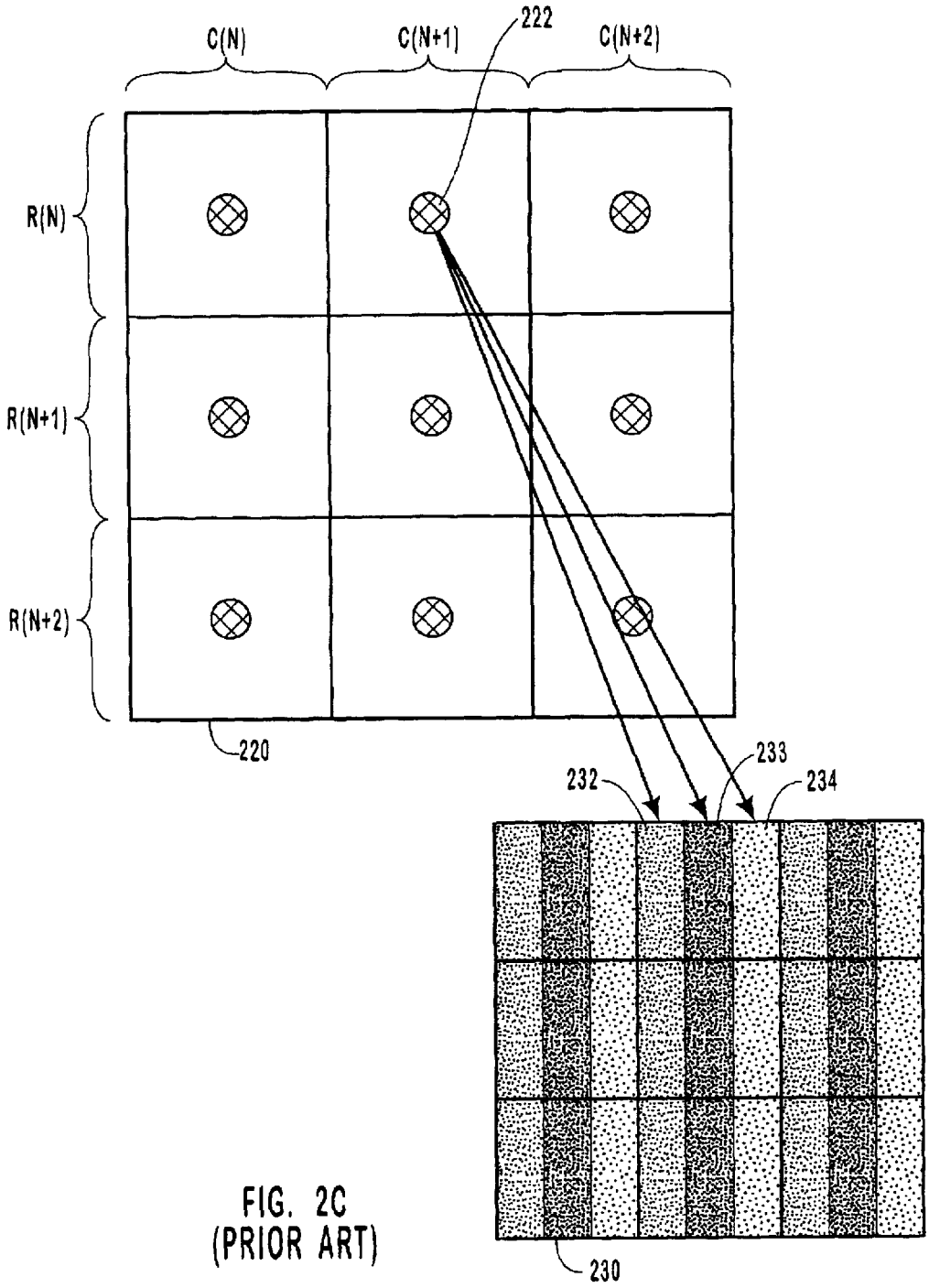
FIG. 2C (PRIOR ART)
FIG. 2C illustrates that each pixel sub-component for a given pixel is generated from the same sample point in accordance with the prior art.

The present invention extends to methods, systems and computer program products for accelerating the rendering and animation of characters that treat each pixel sub-component as a distinct luminance intensity source. Characters that treat each pixel sub-component as a distinct luminance intensity source or, in other words, characters in which each pixel sub-component was generated from a sample, will be referred to herein in this description and in the claims as "sub-component-oriented characters." Sub-component-oriented characters are contrasted with typical images in which a single sample is used to generate all of the pixel sub-component values for a given pixel.

A bit-map representation of the sub-component-oriented character is generated by using a single image sample to generate each pixel sub-component. This may be accomplished by, for example, overscaling a representation of the character, placing the overscaled representation of the character on a grid, and then assigning a luminance and possibly a transparency value to each grid position based on the properties of the overscaled character at that grid position. Then, the character is rendered by interfacing with a hardware graphics unit that performs the final rendering and animation of the character. The rendering and animation speed is increased substantially over the prior method of performing rendering and animating in software. It will be shown below that there are substantial difficulties in animating sub-component-oriented characters using conventional hardware graphics units. These difficulties are overcome using the principles of the present invention.

Embodiments within the scope of the present invention may comprise a special purpose or general purpose computing device including various computer hardware, as discussed in greater detail below. Embodiments within the scope of the present invention also include computer-readable media for carrying or having computer-executable instructions or data structures stored thereon. Such computer-readable media can be any available media which can be accessed by a general purpose or special purpose computer. By way of example, and not limitation, such computer-readable media can comprise physical storage media such as RAM, ROM, EEPROM, CD-ROM or other optical disk storage, magnetic disk storage or other magnetic storage devices, or any other medium which can be used to carry or store desired program code means in the form of computer-executable instructions or data structures and which can be accessed by a general purpose or special purpose computer.

When information is transferred or provided over a network or another communications connection (either hardwired, wireless, or a combination of hardwired or wireless) to a computer, the computer properly views the connection as a computer-readable medium. Thus, any such connection is properly termed a computer-readable medium. Combinations of the above should also be included within the scope of computer-readable media. Computer-executable instructions comprise, for example, instructions and data which cause a general purpose computer, special purpose computer, or special purpose processing device to perform a certain function or group of functions.

Although not required, the invention will be described in the general context of computer-executable instructions, such as program modules, being executed by computing devices. Generally, program modules include routines, programs, objects, components, data structures, and the like that perform particular tasks or implement particular abstract data types. Computer-executable instructions, associated data structures, and program modules represent examples of the program code means for executing steps and acts of the methods disclosed herein.

Those skilled in the art will appreciate that the invention may be practiced in network computing environments with many types of computer system configurations, including personal computers, hand-held devices, multi-processor systems, microprocessor-based or programmable consumer electronics, network PCs, minicomputers, mainframe computers, and the like. The invention may also be practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

Figure 4:
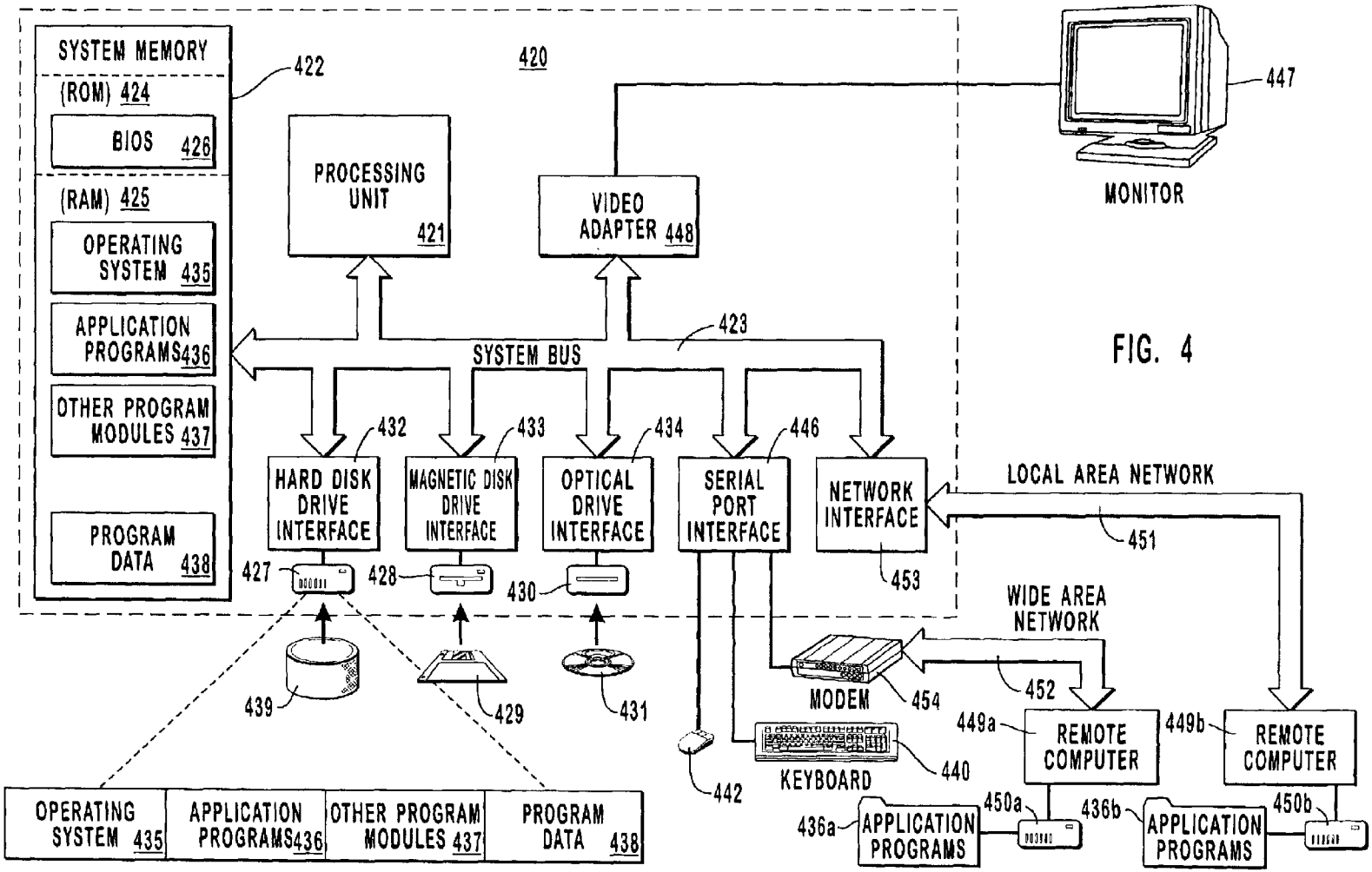
FIG. 4 illustrates an example computing environment that represents a suitable operating environment for the present invention.

With reference to FIG. 4, an example system for implementing the invention includes a general purpose computing device in the form of a computer 420, including a processing unit 421, a system memory 422, and a system bus 423 that couples various system components including the system memory 422 to the processing unit 421. The system bus 423 may be any of several types of bus structures including a memory bus or memory controller, a peripheral bus, and a local bus using any of a variety of bus architectures. The system memory includes read only memory (ROM) 424 and random access memory (RAM) 425. A basic input/output system (BIOS) 426, containing the basic routines that help transfer information between elements within the computer 420, such as during start-up, may be stored in ROM 424.

The computer 420 may also include a magnetic hard disk drive 427 for reading from and writing to a magnetic hard disk 439, a magnetic disk drive 428 for reading from or writing to a removable magnetic disk 429, and an optical disk drive 430 for reading from or writing to removable optical disk 431 such as a CD-ROM or other optical media. The magnetic hard disk drive 427, magnetic disk drive 428, and optical disk drive 430 are connected to the system bus 423 by a hard disk drive interface 432, a magnetic disk drive-interface 433, and an optical drive interface 434, respectively. The drives and their associated computer-readable media provide nonvolatile storage of computer-executable instructions, data structures, program modules and other data for the computer 420. Although the exemplary environment described herein employs a magnetic hard disk 439, a removable magnetic disk 429 and a removable optical disk 431, other types of computer readable media for storing data can be used, including magnetic cassettes, flash memory cards, digital versatile disks, Bernoulli cartridges, RAMs, ROMs, and the like.

Program code means comprising one or more program modules may be stored on the hard disk 439, magnetic disk 429, optical disk 431, ROM 424 or RAM 425, including an operating system 435, one or more application programs 436, other program modules 437, and program data 438. A user may enter commands and information into the computer 420 through keyboard 440, pointing device 442, or other input devices (not shown), such as a microphone, joy stick, game pad, satellite dish, scanner, or the like. These and other input devices are often connected to the processing unit 421 through a serial port interface 446 coupled to system bus 423. Alternatively, the input devices may be connected by other interfaces, such as a parallel port, a game port or a universal serial bus (USB). A monitor 447 or another display device is also connected to system bus 423 via an interface, such as video adapter 448. In addition to the monitor, personal computers typically include other peripheral output devices (not shown), such as speakers and printers.

The computer 420 may operate in a networked environment using logical connections to one or more remote computers, such as remote computers 449*a* and 449*b*. Remote computers 449*a* and 449*b* may each be another personal computer, a server, a router, a network PC, a peer device or other common network node, and typically include many or all of the elements described above relative to the computer 420, although only memory storage devices 450*a* and 450*b* and their associated application programs 436*a* and 436*b* have been illustrated in FIG. 4. The logical connections depicted in FIG. 4 include a local area network (LAN) 451 and a wide area network (WAN) 452 that are presented here by way of example and not limitation. Such networking environments are commonplace in office-wide or enterprise-wide computer networks, intranets and the Internet.

When used in a LAN networking environment, the computer 420 is connected to the local network 451 through a network interface or adapter 453. When used in a WAN networking environment, the computer 420 may include a modem 454, a wireless link, or other means for establishing communications over the wide area network 452, such as the Internet. The modem 454, which may be internal or external, is connected to the system bus 423 via the serial port interface 446. In a networked environment, program modules depicted relative to the computer 420, or portions thereof, may be stored in the remote memory storage device. It will be appreciated that the network connections shown are exemplary and other means of establishing communications over wide area network 452 may be used.

The computer 420 is a mere example of a general-purpose computing device that may implement the principles of the present invention. In one embodiment, the computer 420 may be physically structured as shown for computer 100 of FIG. 1. In that case, the monitor 447 may be, for example, the display device 104.

Figure 5:
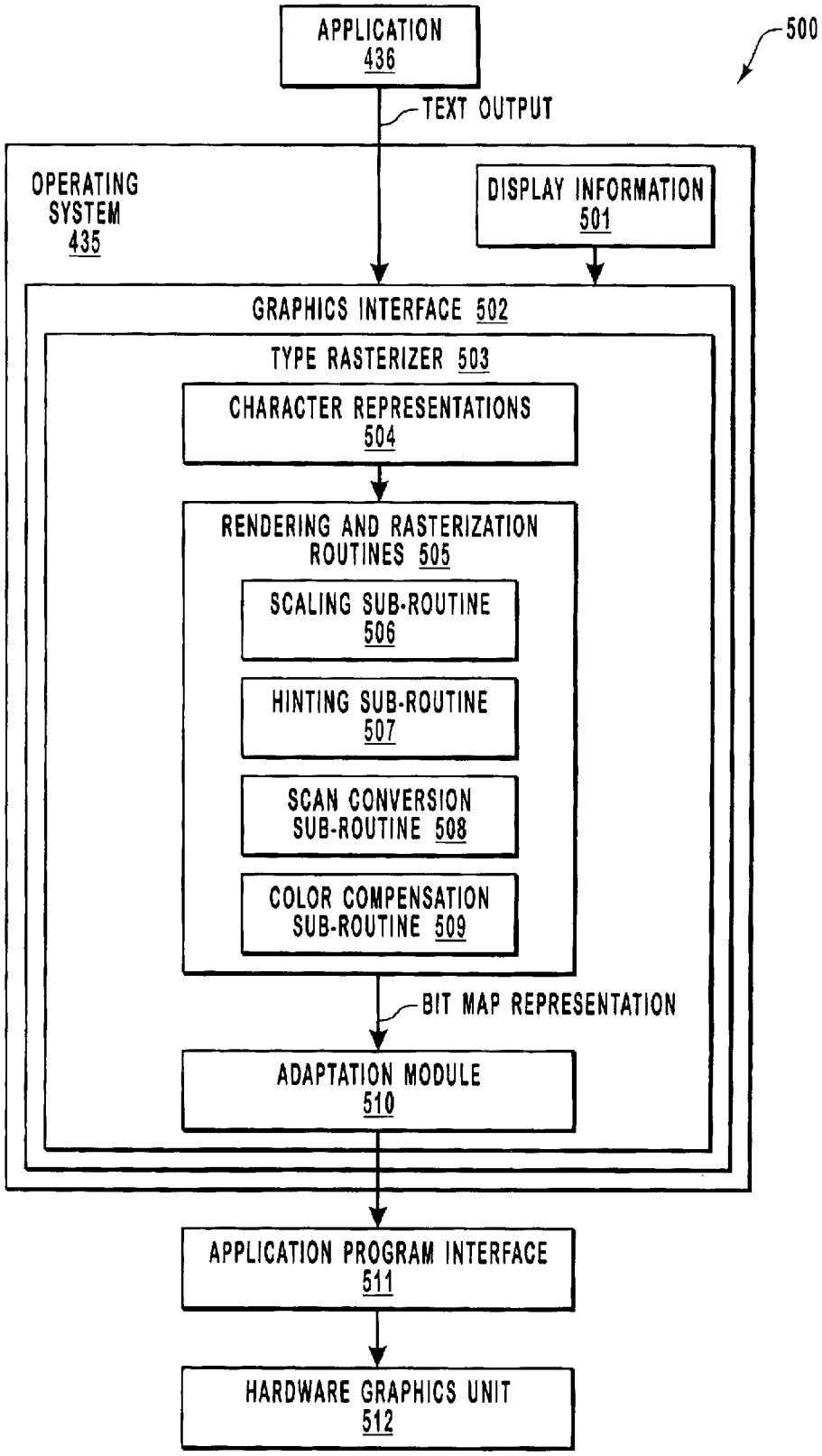
FIG. 5 illustrates a system that may implement the features of the present invention including an application, an operating system, and a hardware graphics unit that receives function calls via an Application Program Interface in accordance with the present invention.

FIG. 5 illustrates a system 500 that includes various elements used to render character images on the monitor 447 in accordance with the present invention. The application 436 and the operating system 435 are implemented in system memory 422 as the processor 421 executes the various methods associated with the application and operating system. Accordingly, the application 436 and the operating system 435 are implemented in software. The system 500 also includes a hardware graphics unit 512.

The operating system 435 makes function calls to thereby control the hardware graphics unit 512. The set of rules governing the structure of available function calls is often referred to as an Application Program Interface or API. Accordingly, Application Program Interface 511 is illustrated between the operating system 435 and the hardware graphics unit 512 indicating that functions are called and returned in accordance with the set of rules defined by the Application Program Interface 511.

During operation, the application 436 outputs text information to the operating system 435 for rendering on the monitor 447 The application may be, for example, a word processing application, a web page design application, or any other of enumerable applications that rely on text being displayed. The output text information includes, for example, information identifying the characters to be rendered, the font to be used during rendering, the point size of the characters, and the brush textures (i.e., colors and transparency values) that are to be applied when rendering the character.

The operating system 435 includes various components responsible for controlling the display of text on the monitor 447. These components include display information 501 and a graphics interface 502. The display information 501 includes, for example, information on scaling to be applied during rendering and/or background color information.

The graphics interface 502 includes routines for processing graphics as well as routines, such as type rasterizer 503, for processing commonly occurring characters such as text. The type rasterizer 503 includes character representations 504 and rendering and rasterization routines 505. The character representations 504 may include, for example, information concerning the outline of the character such as, for example, vector graphics, lines, points and curves. There are a variety of conventional techniques for representing the outline of a character. The outline information may be used to generate a bit map representation of the character at varying desired levels of resolution.

The rendering and rasterization routines 505 include a scaling sub-routine 506, a hinting sub-routine 507, a scan conversion sub-routine 508 and a color compensation sub-routine 509. The operation of these various sub-routines 506, 507, 508 and 509 to generate a pixel-subcomponent-oriented character may be the same as described above with respect to the Hill et al. patent. However, unlike software-only embodiments of the Hill et al. patent, the graphics interface 502 interfaces with a hardware graphics unit 512. In particular, the graphics interface 502 uses application program interface 511 to issue function calls to the hardware graphic unit 512, and to potentially receive responses back from the hardware graphics unit 512.

Configuring the graphics interface 502 to interact with the hardware graphics unit 512 is far more than a trivial problem. After all, the desired character to be rendered or animated has been constructed so that each pixel sub-component is generated from a different sampling point. However, conventional hardware graphics units are configured such that each pixel sub-component in a given pixel is generated from a common sample point, with the pixel sub-components only contributing to the appearance of the pixel at that sample point. In accordance with the principles of the present invention, conventional hardware graphics units may be used to render and animate pixel sub-component-oriented characters, even though the Application Program Interfaces or APIs corresponding to those hardware graphics units were not drafted to treat each pixel sub-component as a separate luminous intensity source.

In order to modify the sub-component-oriented character as appropriate, and to issue the appropriate function calls to the hardware graphics unit 512, the graphics interface 502 includes an adaptation module 510. The adaptation module 510 receives a bit map representation of a character, as well as a bit map representation of the brush to be applied to the character. The bit map representation of the brush includes a luminous intensity value, as well as a transparency value for each pixel sub-component. Thus, each RGB pixel includes six values, a luminous intensity value (brush.r) and a transparency value (brush.ar) for the red pixel sub-component, a luminous intensity value (brush.g) and a transparency value (brush.ag) for the green pixel sub-component, and a luminous intensity value (brush.b) and a transparency value (brush.ab) for the blue pixel sub-component. Accordingly, each pixel of a sub-component-oriented character includes three luminous intensity values, and three transparency values.

One conventional Application Program Interface (API) for interfacing with a wide variety of hardware graphics units is called MICROSOFT® DIRECTX®. DirectX® allows for the manipulation of pixels that have three brush color intensity values, one for each of red, green, and blue. DirectX also allows for one transparency value that corresponds the transparency at the pixel as a whole. However, as previously mentioned, the sub-component-oriented character potentially includes three transparency values for each pixel in order to promote a higher-resolution feel to the character.

Figure 6:
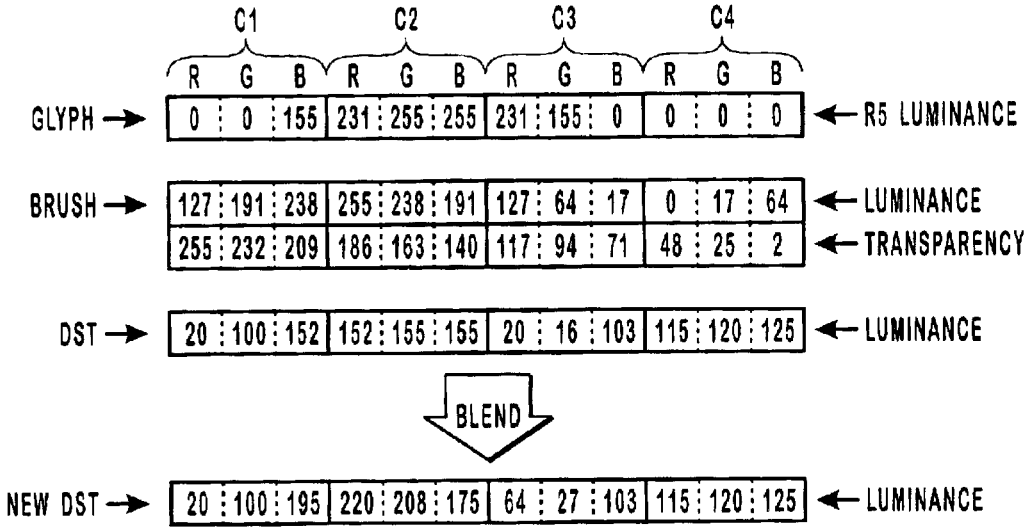
FIG. 6 illustrates a variety of data structure involved with blending a character on a background in accordance with the present invention.

The adaptation module 510 compensates for this seeming incompatibility between conventional hardware APIs and sub-component-oriented pixel processing in accordance with the present invention. FIG. 6 illustrates various data structures that are used in order to perform a relatively complex operation of rendering text above a non-solid background image such as an already existing image using a non-solid semi-transparent brush. This operation is sometimes referred to as "blending."

Referring to FIG. 6, there are four relevant data structures that allow for blending to be performing on a sub-component-oriented basis. Three of the data structures are provided as inputs to the adaptation module 510. These include a data structure that defines the shape of the character (i.e., the glyph), a data structure that defines the brush, and a data structure that defines the background (i.e., DST) upon which the brush is to be applied to form the new. The fourth data structure called NewDST defines the new image after the blending operation is performed.

The glyph data structure is obtained by referencing the four columns C1 through C4 of the fifth row R5 of the hinted letter i (see character 312' of grid pattern 313B of FIG. 3). Suppose this letter i is a white letter i formed on a black background. Referring to element 313B, column 4 of row 5 is simply the black background. Accordingly, column 4 of the glyph data structure in FIG. 6 contains a value of zero, indicative of a black background, for each of the red, green, and blue sub-components of the pixel. Likewise, referring to element 313B, the red and green sub-components of the first pixel in column C1, as well as the blue sub-component of the third pixel in column C3, are each part of the black background. Accordingly, these corresponding pixel sub-components are also assigned a zero value in the glyph data structure of FIG. 6.

Referring to element 313B, the green and blue sub-components of the pixel in column C2 are mapped completely within the white character i. Accordingly, these pixel sub-components are assigned a maximum value. In the case in which 8 bits are used to assign an integer value to the luminance intensity, the luminance intensity may be assigned an integer value between 0 and 255. Accordingly, the corresponding pixel sub-components in the glyph data structure of FIG. 6 are assigned a value of 255.

Referring again to element 313B, the remaining pixel sub-components (i.e., the blue sub-component of column C1, the red sub-component of column C2, and the red and green sub-components of column C3) contain some black background and some white character portions. A value between 0 and 255 is assigned to the corresponding pixel sub-components of the glyph character of FIG. 6 that is roughly proportional to the percentage of area covered by the white character. For example, the blue sub-component of column C1 and the green sub-component of column 3 are covered by white character portions at a ratio of approximately 155/255. Accordingly, these pixel sub-components are assigned a value of 155 in the glyph character of FIG. 6. The red sub-component of column C2 and the red sub-component of column C3 are covered by white character portions at a ratio of approximately 231/255. Accordingly, these pixel sub-components are assigned a value of 231 in the glyph character of FIG. 6.

As previously mentioned, the glyph data structure of FIG. 6 describes the shape of the letter i in the four columns C1 through C4 of the fifth row R5 in the grid structure 313B of FIG. 3. For clarity, the blending operation is described with respect to this limited area although the other portions of the character would also be processed in a similar manner. The other data structures are also limited to this small area of the character for clarity.

The example brush data structure of FIG. 6 includes six values for each RGB pixel, one luminance intensity value and one transparency value for each of the three RGB pixel sub-components. The luminance intensity value varies approximately sinusoidally between 0 and 255 with a period of approximately 4 pixel columns. The transparency value begins at 255 and decreases linearly down to 2. A value of 0 for the brush transparency value indicates that the brush is completely transparent, while a value of 255 indicates that the brush is completely opaque.

The example DST data structure of FIG. 6 describes the background upon which the brush is to be applied. If the background were simply a solid color, each pixel would have the same values for each of the red, green, and blue pixel sub-components. However, in this example, the background is non-solid as in the case where a character is being rendered on top of an already existing image.

The NewDST data structure is calculated for each pixel sub-component based on the following blending equation (2):

$$\text{New}DST=DST+(\text{Brush}.c-DST)*\text{Glyph}(F)*\text{Brush}.a(F) \quad (2)$$

where,

Brush.c is the brush color value for the sub-component;

Brush.a is the brush transparency value for the sub-component; and

Brush.a(F) is the floating point value of Brush.a normalized to a value between zero and one; and Glyph(F) is the floating-point value of Glyph normalized to a value between zero and one.

To complete the example, this equation is performed for each of the twelve sub-components in the example to generate the values for the twelve pixel sub-components in the new image NewDST.

These calculations perform blending for each pixel sub-component. However, conventional hardware APIs are not drafted to treat each pixel sub-component as a separate luminance intensity source with its own corresponding sample point. Accordingly, the adaptation module 510 performs some modifications on the input data structures of FIG. 6 and then issues an unconventional sequence of function calls in order to "trick" the hardware API into performing sub-component-oriented blending operations.

In particular, the glyph data structure is three times overscaled. Then, the luminance intensity value is assigned to a transparency "alpha" value for the pixel. This modification is illustrated in the first arrow 701 of FIG. 7. The number of pixel columns is tripled to twelve. However, there is only a transparency value for each pixel in the glyph. This conforms with DirectX requirements.

In order to eliminate color fringing effects, the color conversion sub-routine 509 may then reassign a new value to each column equal to the average of the previous value of the current column, the previous value of the column to the left, and the previous value of the column to the right. For example, the pixel in column C8 may be reassigned a value of 129, which is the average of 231, 155 and 0. This averaging operation is illustrated by the second arrow 702 of FIG. 7. Although the averaging operation is illustrated as occurring after the overscaling operation, the averaging operation may occur before the overscaling without changing the result.

Next, three passes of rendering may be performed, one pass to generate a frame buffer 703 of red sub-components, one pass to generate a frame buffer 704 of green sub-components, and one pass to generate a frame buffer 705 of blue sub-components. In order to lock these three color channels in the output renderer, the adaptation module 510 may make the following three DirectX 8.1 function calls to the hardware graphics unit 512.

IDirect3DDevice8::SetRenderState(D3DRS_COLORWRITEENABLE, COLORWRITEENABLE_RED)

IDirect3DDevice8::SetRenderState(D3DRS_COLORWRITEENABLE, COLORWRITEENABLE_GREEN)

IDirect3DDevice8::SetRenderState(D3DRS_COLORWRITEENABLE, COLORWRITEENABLE_BLUE)

The "SetRenderState" method sets a single device render-state parameter. The state variable "D3DRS_COLORWRITEENABLE" enables a per-channel write for a specified target color buffer. The first, second, and third function calls specify the red, green, and blue color buffers, respectively, as the target color buffer.

Next, each color is rendered. For the red color, the glyph transparency values that previously corresponded to a red color sub-component (i.e., columns C1, C4, C7 and C10) are used to populate the red target color buffer 703. Similarly, columns C2, C5, C8 and C11 are used to populate the green target color buffer 704, and the columns C3, C6, C9 and C12 are used to populate the blue target color buffer 705.

The colors may be rendered to their various color buffers using DirectX 8.1 function calls in a variety of manners. For example, the brush may have a solid color in which the same color is used for each pixel. Alternatively, the brush may be textured in which different colors may be used for each pixel. The brush may also be opaque or semitransparent. The background surface may be the final surface that is to be reflected on the screen, or may be an intermediate surface. Intermediate background surfaces can contain not only the RGB color values, but also transparency values for each pixel.

The next portion of this description describes a C++ routine called "DrawGlyphExample" that performs a rendering technique in which the destination surface has only the RGB color values, but not the transparency value, and the brush is textured so that each pixel contains four values, one value for each of the RGB colors, and one transparency value that is common for the whole pixel. The routine DrawGlyphExample operates to draw the four pixels of FIG. 7 (corresponding to columns C1 through C4. The code portions will be presented segment-by-segment for clarity.

First, the various arguments used in the code will be summarized. "pDev" is a pointer to "IDirect3DDevice8" which is a basic DirectX 8.1 object that implements many parts of the DirectX 8.1 drawing API. "pGlyphTexture" is a pointer to the texture that contains prepared glyph data. For clarity, this texture is assumed to have a 256*256 size and to contain glyph transparency data corresponding to columns C1 through C12 in the left-top corner of the screen, as elements [0][0] to [0][11]. "pBrushTexture" is a pointer to a texture that contains prepared brush data. For clarity, this texture is assumed to have a 256*256 size and to contain brush color and transparency data corresponding to columns C1 through C4 in the left-top corner, as elements [0][0] through [0][3].

The following code example begins the DrawGlyphsExample routine:

```
void DrawGlyphsExample(IDirect3DDevice8 *pDev,
    IDirect3DTexture8 *pGlyphTexture,
    IDirect3DTexture8 *pBrushTexture)
{
```

In order to define the shape of the glyph and its position on the screen, and also how the brush picture should be stretched and positioned on the screen, the DirectX coordinate information resides in the following structure called "TheVertex":

```
struct TheVertex
{
public:
    float x, y, z, w;
    float bx, by;
    float gx, gy;
} vertices[4];
```

Here, "x" and "y" represent a point on the screen. "z" and "w" are not used in this two-dimensional example, but may be used for three-dimensional graphics. "bx" and "by" represents a point on the brush texture surface. "gx" and "gy" represent a point on the glyph texture surface.

The shape of the glyph is rectangular, so the complete coordinate definition requires an array of four vertices. The following operators fill the four vertices with particular coordinates matching the example on FIG. 7:

```
#define X 0
#define Y 0
#define W 4
#define H 4
vertices[0].x=X; vertices[0].y=Y;
vertices[1].x=X+W; vertices[1].y=Y;
vertices[2].x=X+W; vertices[2].y=Y+H;
vertices[3].x=X; vertices[3].y=Y+H;
```

In this segment, "X" is to be the X coordinate at the top-left glyph corner of the resulting glyph images as positioned in the screen window. "Y" is to be the Y coordinate of this corner as positioned in the screen window. "W" is to be the width of the resulting glyph rectangle in the screen window. "H" is to be the height of the resulting glyph rectangle in the screen window.

The following two lines are used to eliminate the third dimension:

```
vertices[0].z=vertices[1].z=vertices[2].z=vertices[3].z=0;
vertices[0].w=vertices[1].w=vertices[2].w=vertices[3].w=1;
```

The following defines the vertices of the glyph texture.

```
#define GWT 256.f
#define GHT 256.f
#define GX 0
#define GY 0
#define GW 12
#define GH 1
vertices[0].gx=(GX )/GWT; vertices[0].gy=(GY )/GHT;
vertices[1].gx=(GX+GW)/GWT; vertices[1].gy=(GY
  )/GHT;
vertices[2].gx=(GX+GW)/GWT; vertices[2].gy=(GY+GH)/
  GHT;
vertices[3].gx=(GX)/GWT; vertices[3].gy=(GY+GH)/GHT;
```

In this segment, "GWT" is to be the width of the whole glyph texture, "GHT" is to be the height of the whole glyph texture, "GX" is to be the X coordinate of the glyph information inside the texture surface, "GY" is the Y coordinate of the glyph information inside the texture surface, "GW" is the width of the overscaled glyph data rectangle, and "GH" is the height of the glyph data rectangle.

The following defines the vertices of the brush texture:

```
#define BWT 256.f
#define BHT 256.f
#define BX 0
#define BY 0
#define BW 12
#define BH 1
vertices[0].bx=(BX)/BWT; vertices[0].by=(BY )/BHT;
vertices[1].bx=(BX+BW)/BWT; vertices[1].by=(BY )/BHT;
vertices[2].bx=(BX+BW)/BWT;  vertices[2].by=(BY+BH)/
  BHT;
vertices[3].bx=(BX )/BWT; vertices[3].by=(BY+BH)/BHT;
```

In this segment, "BWT" is to be the width of the whole brush texture, "BHT" is to be the height of the whole brush texture, "BX" is to be the X coordinate of the brush information inside the texture surface, "BY" is the Y coordinate of the brush information inside the texture surface, "BW" is the width of a rectangle on the brush surface that should be mapped to the glyph, and "BH" is the height of the rectangle on the brush surface that should be mapped to the glyph.

Next, a sequence of preliminary DirectX 8.1 adjustment API calls are made. The rendering will involve two texture stages. The texture stage is the part of the hardware that is capable of fetching data from the texture and manipulating the data. All the texture stages work in parallel. The texture stage executes the same operations on each pixel in the flow. The conventional hardware can contain up to eight texture stages, distinguishable by numbers from 0 to 7.

In this example, texture stage 0 will handle brush texture data. The following DirectX 8.1 function call orders texture stage 0 to use the brush texture:

```
pDev->SetTexture(0, pBrushTexture);
```

The following DirectX 8.1 function calls instruct the texture stage 0 to fetch data from the texture, without performing any calculations, so that the texture stage 0 output register contains the brush.rgb and brush.a values:

```
pDev->SetTextureStageState(0, D3DTSS_COLORARG1,
  D3DTA_TEXTURE);
pDev->SetTextureStageState(0, D3DTSS_ALPHAARG1,
  D3DTA_TEXTURE);
pDev->SetTextureStageState(0, D3DTSS_COLOROP,
  D3DTOP_SELECTARG1);
pDev->SetTextureStageState(0, D3DTSS_ALPHAOP,
  D3DTOP_SELECTARG1);
```

The following DirectX 8.1 function call instructs texture stage 0 to use the first set (bx, by) of TheVertex structure:

```
pDev->SetTextureStageState(0, D3DTSS_
  TEXCOORDINDEX, 0);
```

The following DirectX 8.1 function call informs texture stage 0 that the texture coordinate is two-dimensional:

```
pDev->SetTextureStageState(0,
D3DTSS_TEXTURETRANSFORMFLAGS,
    D3DTTFF_COUNT2);
```

Texture stage 1 will handle glyph texture data. Accordingly, the following DirectX 8.1 function call orders texture stage 1 to handle glyph texture data:

```
pDev->SetTexture(1, polyphTexture);
```

The following DirectX 8.1 function calls instruct the color channel of texture stage 1 to get data from texture stage 0 without performing any further calculations:

pDev->SetTextureStageState(1, D3DTSS_COLORARG2, D3DTA_CURRENT);

pDev->SetTextureStageState(1, D3DTSS_COLOROP, D3DTOP_SELECTARG2);

The following DirectX 8.1 function calls instruct the alpha channel of texture stage 1 to get the first alpha value from the texture stage 0, to fetch the second alpha value from the texture, then to multiply these two values and convey the result into the output register:

pDev->SetTextureStageState(1, D3DTSS_ALPHAARG1, D3DTA_TEXTURE);

pDev->SetTextureStageState(1, D3DTSS_ALPHAARG2, D3DTA_CURRENT);

pDev->SetTextureStageState(1, D3DTSS_ALPHAOP, D3DTOP_MODULATE);

The following DirectX 8.1 function call instructs the texture stage 1 to use the second set (gx,gy) of TheVertex structure:

pDev->SetTextureStageState(1, D3DTSS_TEXCOORDINDEX, 1);

The following DirectX 8.1 function call informs texture stage 1 that the texture coordinate is two-dimensional:

```
pDev->SetTextureStageState(1,
D3DTSS_TEXTURETRANSFORMFLAGS,
    D3DTTFF_COUNT2);
```

The output register of texture stage 1 will supply so far four values: brush.rgb and brush.a*glyph.a.

The following DirectX 8.1 function call disables texture stage 2:

pDev->SetTextureStageState(2, D3DTSS_COLOROP, D3DTOP_DISABLE);

As a result, the output register of texture stage 1 will be directed to the output rasterizer.

The output rasterizer is also the part of hardware that is able to fetch the data from a destination pixel buffer, accept data from a particular texture stage state, execute a blending operation, and store the result back to a destination buffer. The output rasterizer also requires preliminary adjustment.

The following DirectX 8.1 function call enables blending:

pDev->SetRenderState(D3DRS_ALPHABLENDENABLE, TRUE);

The following DirectX 8.1 function call instructs the rasterizer to multiply color values, fetched from the destination buffer, by the inversed alpha value obtained from texture stage 1.

pDev->SetRenderState(D3DRS_DESTBLEND, D3DBLEND_INVSRCALPHA);

The "Inversed alpha" value means one minus the alpha value.

The following DirectX 8.1 function call instructs the rasterizer to multiply color values, obtained from texture stage 1, by the alpha value also obtained from texture stage 1.

pDev->SetRenderState(D3DRS_SRCBLEND, D3DBLBND_SRCALPHA);

As a result, the rasterizer will execute the formula newdst.rgb=dst.rgb*(1−stage.a)+stage.rgb*stage.a, where stage.rgb=brush.rgb and stage.a=brush.a*glyph.a are the values calculated by texture stage 1, where "dst" and "newdst" mean destination buffer pixel values.

Finally this gives newdst.rgb=dst.rgb+(brush.rgb−dst.rgb) *brush.a*glyph.a. The rasterizer thereby will calculate three numbers, one for each of red, green and blue components, respectively. However not all three will be stored, due to the additional settings set forth below.

The following DirectX 8.1 function call informs the Direct3D device of the format of TheVertex structure:

SetVertexShader(D3DFVF_XYZRHW|D3DFVF_TEX2);

Then, the routine makes three passes for each of the color components: red, green, and blue.

The following code segment renders the red color component. The code includes comments that explain the functioning proximate to that code.

```
{
    // shift the glyph vertices by 1 overscaled pixel to left.
    // This will effectively move the glyph data so as
    // centers of the screen pixels will be mapped
    // to glyph pixels with indices 0, 3, 6 and 9.
    for (int i = 0; i < 4; i++) vertices[i].gx -= 1/GWT;
    // instruct the rasterizer to store only red values
    pDev->SetRenderState(D3DRS_COLORWRITEENABLE,
        D3DCOLORWRITEENABLE_RED);
    // Draw the rectangle as a set of two adjacent triangles
    pDev->DrawPrimitiveUP(D3DPT_TRIANGLEFAN, 2, vertices,
        sizeof(TheVertex));
}
```

The following code segment renders the green color component.

```
{
    // shift the glyph vertices by 1 pixel back to right.
    // This will effectively move the glyph data so as
    // centers of the screen pixels will be mapped
    // to glyph pixels with indices 1, 4, 7 and 10.
    for (int i = 0; i < 4; i++) vertices[i].gx += 1/GWT;
    // instruct the rasterizer to store only green values
    pDev->SetRenderState(D3DRS_COLORWRITEENABLE,
        D3DCOLORWRITEENABLE_GREEN);
    // Draw the rectangle as a set of two adjacent triangles
    pDev->DrawPrimitiveUP(D3DPT_TRIANGLEFAN, 2, vertices,
        sizeof(TheVertex));
}
```

The following code segment renders the blue color component.

```
{
    // shift the glyph vertices by 1 pixel more to right.
    // This will effectively move the glyph data so as
    // centers of the screen pixels will be mapped
    // to glyph pixels with indices 2, 5, 8 and 11.
    for (int i = 0; i < 4; i++) vertices[i].gx += 1/GWT;
    // instruct the rasterizer to store only blue values
    pDev->SetRenderState(D3DRS_COLORWRITEENABLE,
        D3DCOLORWRITEENABLE_BLUE);
    // Draw the rectangle as a set of two adjacent triangles
    pDev->DrawPrimitiveUP(D3DPT_TRIANGLEFAN, 2, vertices,
        sizeof(TheVertex));
}
```

Thus, during this three pass rendering technique, the formula newdst.rgb=dst.rgb+(brush.rgb−dst.rgb) *brush.a*glyph.a has been calculated three times. Each time, the same brush values were used, but with different glyph.a values on each pass. For the sake of completeness, the following line of code (i.e., the closing bracket) simply ends the routine:

}// End of example routine

Thus, with some preliminary manipulation of the glyph data structure, and by performing the rendering using three passes, each pass being rendered in a non-standard manner, the hardware graphics unit 512 may be caused to perform sub-component-oriented rendering even if the Application Program Interface 511 was not designed to treat each pixel sub-component as a separate luminous intensity source.

Accordingly, the principles of the present invention provide for the higher resolution appearance of rendering a display in which each pixel sub-component is treated as a separate luminous intensity source generated from a distinct sample point. In addition, operations such as blending may be performed by a hardware graphics unit thereby accelerating the rendering process.After having reviewed this description, those of ordinary skill in the art will recognize that other operations may also be performed on the sub-component-oriented image using the hardware graphics unit 512. In particular, the principles of the present invention may be used to scale and rotate a given character on a background using hardware acceleration.

Using the example subroutine just described, one may use the principles of the present invention to achieve effects such as rotation and scaling by changing the values vertices[i].x and vertices[i].y. The glyph may be placed on a desired area of the screen window, with all the calculations for the glyph and brush transformations provided automatically by the hardware controlled by DirectX 8.1 using, for example, the above-listed example subroutine. For each pixel on the screen, the hardware will calculate corresponding points in the glyph and brush textures.

For arbitrary affine transformations, the coordinates of the vertices would not typically be an integer value. In that case, the conventional hardware may use the nearest integers as the indices to fetch corresponding point values from the texture. However, this rounding produces a somewhat rough picture. The picture may be refined by using DirectX 8.1 settings to force the hardware to use fractional parts of calculated texture coordinates for bilinear interpolation between four nearest points. This can be achieved by the following DirectX 8.1 settings:

pDev->SetTextureStageState(1, D3DTSS_MAGFILTER, D3DTFG_LINEAR);

pDev->SetTextureStageState(1, D3DTSS_MINFILTER, D3DTFG_LINEAR);

Bilinear interpolation provides for smooth stretching and improved visual appeal of animated glyph images. Although bilinear interpolation requires significant calculations, the rendering speed is substantially unaffected when conventional hardware is used. This is because these calculations are provided for in separate parts of hardware that work in parallel with the hardware parts that fulfill the DirectX 8.1 function calls listed in the example subroutine.

Figure 7:
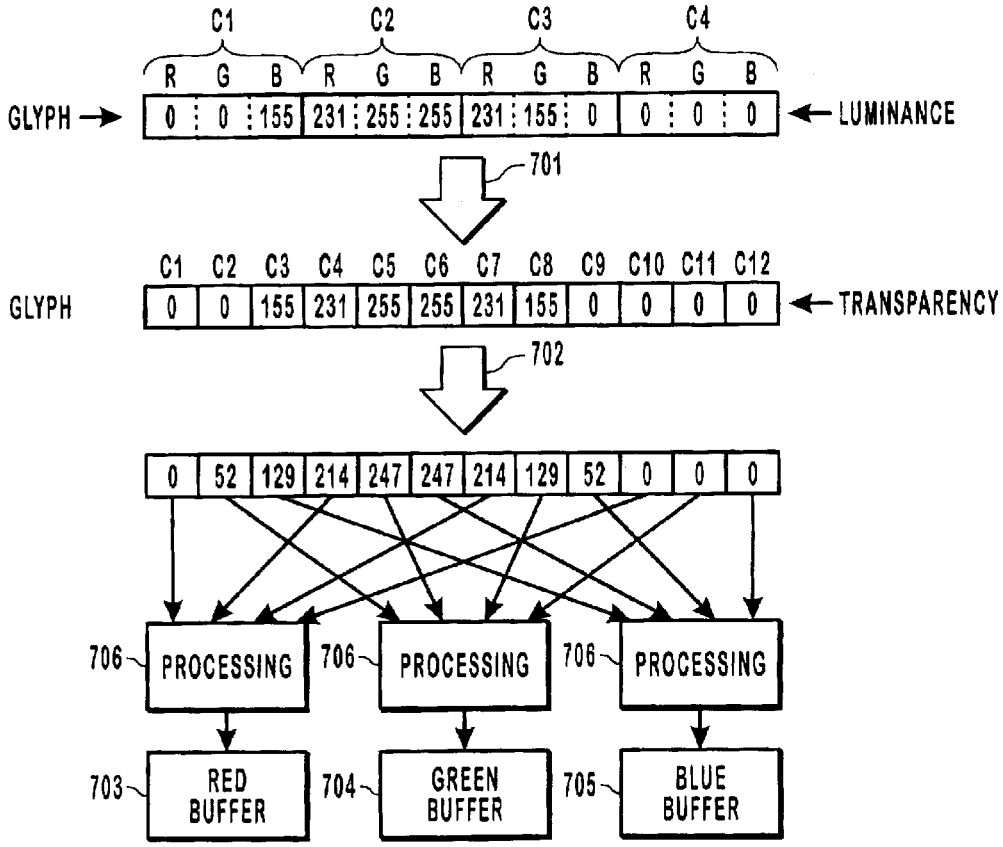
FIG. 7 illustrates a functional flow involved with processing the glyph data structure of FIG. 6 in order to perform a three-pass rendering technique in accordance with the present invention.

The scaling transformation mentioned above does not require glyph and brush texture rebuilding. When generating the next frame, only coordinate information is changed. However, the scaling is related to how the glyph texture is prepared. When transformation is not required, the color compensation routine 509 of FIG. 5 would be used, and the averaging represented by arrow 702 in FIG. 7 is not used. In contrast, when the transformation is applied and animated (changed on each frame), the color flickering effect may be reduced by foregoing the color compensation routine 509, and instead using the averaging represented by arrow 702. In a sense, the averaging procedure 702 is a special kind of color compensation routine providing color balance when the glyph is scaled.

Since these various operations such as blending, scaling, and rotating may be performed with the assistance of hardware graphics units which may typically perform such operations faster than in software, the rendering and animation of a given character may be significantly improved.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. In a computer system including a processing unit, a hardware graphics unit, and a display device for displaying an image, the hardware graphics unit capable of responding to function calls received via an application program interface, the display device having a plurality of pixels, at least some of the plurality of pixels including a plurality of pixel sub-components each of a different color, a method for rendering sub-component-oriented characters within the displayed image using the hardware graphics unit, the method comprising the following:

an act of generating a bit-map representation of a sub-component-oriented character that treat each pixel sub-component as a distinct luminance intensity source, by using a sample to generate each pixel sub-component;

an act of processing the sub-component-oriented character to interface the application program interface of the hardware graphic unit, wherein the application program interface is configure to treat each pixel as a single luminance intensity source, rather than treating each pixel sub-component as a single luminance intensity source; and an act of rendering the sub-component-oriented character on the display device by making one or more function calls to the hardware graphics unit using the application program interface.

2. A method in accordance with claim 1, wherein the act of rendering the sub-component-oriented character on the display device comprises the following:

an act of blending the sub-component-oriented character on a background by making one or more function calls to the hardware graphics unit.

3. A method in accordance with claim 2, wherein the act of blending the sub-component-oriented character on the display device comprises the following:

an act of blending the sub-component-oriented character on a non-solid background image by making one or more function calls to the hardware graphics unit.

4. A method in accordance with claim 2, wherein the act of blending the sub-component-oriented character comprises the following:

an act of blending the sub-component-oriented character on a background using a semi-transparent brush by making one or more function calls to the hardware graphics unit.

5. A method in accordance with claim 1, wherein the act of rendering the sub-component-oriented character on the display device comprises the following:

an act of rotating the sub-component-oriented character on a background by making one or more function calls to the hardware graphics unit.

6. A method in accordance with claim 1, wherein the act of rendering the sub-component-oriented character on the display device comprises the following:

an act of scaling the sub-component-oriented character on a background by making one or more function calls to the hardware graphics unit.

7. A method in accordance with claim 1, wherein the act of rendering the sub-component-oriented character on the display device comprises the following:

an act of rendering the sub-component-oriented character on the display device by making one or more function calls that are compatible with DirectX.

8. A method in accordance with claim 1, wherein the act of rendering the sub-component-oriented character on the display device comprises the following:

an act of defining a color channel for each pixel sub-component type; and an act of separately populating a distinct color buffer for each color channel.

9. A computer program product for use in a computer system that includes a processing unit, a hardware graphics unit, and a display device for displaying an image, the hardware graphics unit capable of responding to function calls received via an application program interface, the display device having a plurality of pixels, at least some of the plurality of pixels including a plurality of pixel sub-components each of a different color, the computer program product for implementing a method for rendering sub-component-oriented characters within the displayed image using the hardware graphics unit, the computer program product comprising one or more computer-readable media having stored thereon the following:

computer-executable instructions for generating a bit-map representation of a sub-component-oriented character by treating each pixel sub-component as a distinct luminance intensity source;

computer-executable instructions for sub-component-oriented character to interface with the application program interface of the hardware graphic unit, wherein the application program interface is configured to treat each pixel as a single luminance intensity source, rather than treating each pixel sub-component-oriented as a luminance intensity source; and computer-executable instructions for making one or more function calls to the hardware graphics unit using the application program interface, the function calls configured to cause the hardware graphics unit to render the sub-component-oriented character on the display device.

10. A computer program product in accordance with claim 9, wherein the one or more computer-readable media are physical storage media.

11. A computer program product in accordance with claim 9, wherein the computer-executable instructions for making one or more function calls to the hardware graphics unit comprise the following:

computer-executable instructions for making one or more function calls to the hardware graphics unit that cause the hardware graphics unit to blend the sub-component-oriented character on a background.

12. A computer program product in accordance with claim 11, wherein the computer-executable instructions for making one or more function calls to the hardware graphics unit that cause the hardware graphics unit to blend the sub-component-oriented character on a background comprise the following:

computer-executable instructions for making one or more function calls to the hardware graphics unit that cause the hardware graphics unit to blend the sub-component-oriented character on a non-solid image background.

13. A computer program product in accordance with claim 11, wherein the computer-executable instructions for making one or more function calls to the hardware graphics unit that cause the hardware graphics unit to blend the sub-component-oriented character on a background comprise the following:

computer-executable instructions for making one or more function calls to the hardware graphics unit that cause the hardware graphics unit to blend the sub-component-oriented character on a background using a semi-transparent brush.

14. A computer program product in accordance with claim 9, wherein the computer-executable instructions for making one or more function calls to the hardware graphics unit comprise the following:

computer-executable instructions for making one or more function calls to the hardware graphics unit that cause the hardware graphics unit to rotate the sub-component-oriented character on a background.

15. A computer program product in accordance with claim 9, wherein the computer-executable instructions for making one or more function calls to the hardware graphics unit comprise the following:

computer-executable instructions for making one or more function calls to the hardware graphics unit that cause the hardware graphics unit to scale the sub-component-oriented character on a background.

16. A computer program product in accordance with claim 9, wherein the computer-executable instructions for making one or more function calls to the hardware graphics unit comprise the following:

computer-executable instructions for making one or more function calls to the hardware graphics unit using DirectX.

17. A computer program product in accordance with claim 9, wherein the computer-executable instructions for making one or more function calls to the hardware graphics unit comprise the following:

computer-executable instructions for defining a color channel for each pixel sub-component type; and computer-executable instructions for separately populating a distinct color buffer for each color channel.

18. A computer program product in accordance with claim 9, wherein the computer-executable instructions for making one or more function calls comprise the following:

computer-executable instructions for providing an inter-pixel interpolation of glyph data by means of graphics hardware.

19. A computer system comprising the following:

a processing unit;

a hardware graphics unit configured to respond to function calls via an application program interface that is configured to treat each pixel as a single luminance intensity source, rather than treating each pixel sub-component as a single luminance intensity source;

a display device for displaying an image and having a plurality of pixels, at least some of the plurality of pixels including a plurality of pixel sub-components each of a different color; and one or more computer-readable media having computer-executable instructions stored thereon that, when executed by the processing unit, are configured to instantiate the following:

a scaling unit configured to overscale a character representation;

a scan conversion unit configured to place the overscaled character representation on a grid, and configured to assign at least a luminance intensity value to each grid position based on the properties of the overscaled character representation at that grid position, wherein each grid position corresponds to a particular pixel sub-component, wherein each pixel sub-component of the overscaled character representation corresponds to one or more grid positions; and an adaptation module configured to make one or more function calls to the hardware graphics unit through the application program interface using at least the luminance intensity values assigned to each grid position to cause the hardware graphics unit to render the character represented by the character representation.

* * * * *